US005310051A

United States Patent [19]

Sutherland

[11] Patent Number: 5,310,051

[45] Date of Patent: May 10, 1994

[54] CLIP-TYPE ARTICLE CARRIER

[75] Inventor: Robert L. Sutherland, Kennesaw, Ga.

[73] Assignee: Riverwood International Corporation, Atlanta, Ga.

[21] Appl. No.: 83,139

[22] Filed: Jun. 24, 1993

[51] Int. Cl.[5] ..... B65D 75/00

[52] U.S. Cl. ..... 206/153; 206/161

[58] Field of Search ..... 206/152, 153, 161

[56] References Cited

U.S. PATENT DOCUMENTS

| | | | |
|---|---|---|---|
| 3,245,711 | 4/1966 | Dantoin | 206/153 |
| 3,653,503 | 4/1972 | Arneson | 206/153 |
| 5,201,412 | 4/1993 | Schuster et al. | 206/153 |

*Primary Examiner*—William I. Price

[57] ABSTRACT

A clip-type carrier especially suited for carrying beverage cans. The carrier is comprised of a panel having slots in a folded, wedge-shaped inner support section and in outer support sections for receiving the can chimes. The inner support sections include finger holes covered by tabs connected by transverse fold lines. Curved transverse fold lines extend toward the central portion of the panel from the ends of the first transverse fold lines to form support segments for receiving and withstanding lifting stresses. A reinforcing strip overlies the inner support section of the panel and includes finger holes which are aligned with the finger holes in the support sections.

15 Claims, 3 Drawing Sheets

CLIP-TYPE ARTICLE CARRIER

FIELD OF THE INVENTION

This invention relates to article carriers. More particularly, it relates to clip-type carriers that support articles from the underside of flanges or other lateral projections on the articles.

BACKGROUND OF THE INVENTION

Carriers that grip the upper portions of articles to enable the articles to be lifted and carried are known, particularly in connection with the packaging of beverage cans. Paperboard carriers that have been developed for this purpose have been of two basic designs. In one design a panel is provided with apertures corresponding to the tops of the cans, with foldably connected tabs surrounding the apertures. The top portions of the cans extend through the apertures and the edges of the tabs engage the underside of the can chimes to support the cans. This produces an inherently weak carrier due to the fact that much of the panel is removed in forming the apertures. In addition, there is very little surface area capable of receiving printing or other graphics, and the provision of a handle for lifting the carrier further complicates the design and makes the carrier more expensive. In the second basic design, arcuate slots are provided in a bottom panel for receiving opposite portions of the can chimes, with the adjacent bottom panel edges resulting from the slot formation engaging the underside of the can chime portions. This is typically employed in packages comprised of two adjacent rows of cans, so that the elongated area of the bottom panel between the interior slots folds into a wedge-shaped reinforcing rib extending between the sloped upper portions of the cans. Short side panels connect the bottom panel to top panel flaps, which are glued to the bottom panel, and aligned finger openings in the top panel and in the reinforcing wedge enable the package to be lifted and carried. Although such a carrier provides substantially unbroken areas in the top panel for receiving printed indicia, it falls short of providing the desired level of strength and is too expensive to produce.

It would be desirable to provide a carrier which retains the benefits of known paperboard clip-type carriers, but in addition provides increased strength and economy of manufacture,

BRIEF SUMMARY OF THE INVENTION

The clip-type carrier of the invention is comprised of a support panel which includes two spaced parallel inner fold lines extending longitudinally of the panel and two outer fold lines parallel to and outwardly spaced from the inner fold lines. The support panel includes downwardly extending outer support sections connected to the panel along the outer fold lines and downwardly extending inner support sections connected along the inner fold lines, the inner support sections converging toward each other and being connected to each other along a central fold line to form wedge-shaped reinforcing ribs. Each inner and outer fold line is interrupted by spaced slits which form slots in the support sections for receiving portions of the projecting lips of the articles to thereby support the articles.

A reinforcing strip of a width to span the inner fold lines is attached to the support panel. The inner support sections and the reinforcing strip contain aligned spaced finger holes. Each inner support section finger hole has an inner transverse edge and is at least partially covered by tabs connected to the inner support sections by fold lines extending along the inner transverse edges. The inner support sections further include second transverse fold lines located adjacent the first transverse fold lines, the ends of each second transverse fold line extending from the ends of the first transverse fold lines. The area between each pair of first and second transverse fold lines folds up during lifting to buttress the inner ends of the finger holes and provide a strong support for pressures applied by the finger and thumb.

Preferably, the second transverse fold lines are arcuate in shape, symmetrically arranged about and converging toward a point on the central fold line of the panel, and the finger hole tabs are also symmetrically arranged with respect to the central fold line. In addition, the finger hole tabs preferably include longitudinally extending fold lines for facilitating curving of the tabs when the inner support sections are folded into final position and also when they are subjected to the pressures of the thumb and finger of a user during lifting of the carrier.

The features of the invention which enable it to provide the desired results are brought out in more detail in the description of the preferred embodiment, wherein the above and other aspects of the invention, as well as other benefits, will readily become apparent.

DETAILED DESCRIPTION OF THE PREFERRED EMBODIMENT

Figure 1:
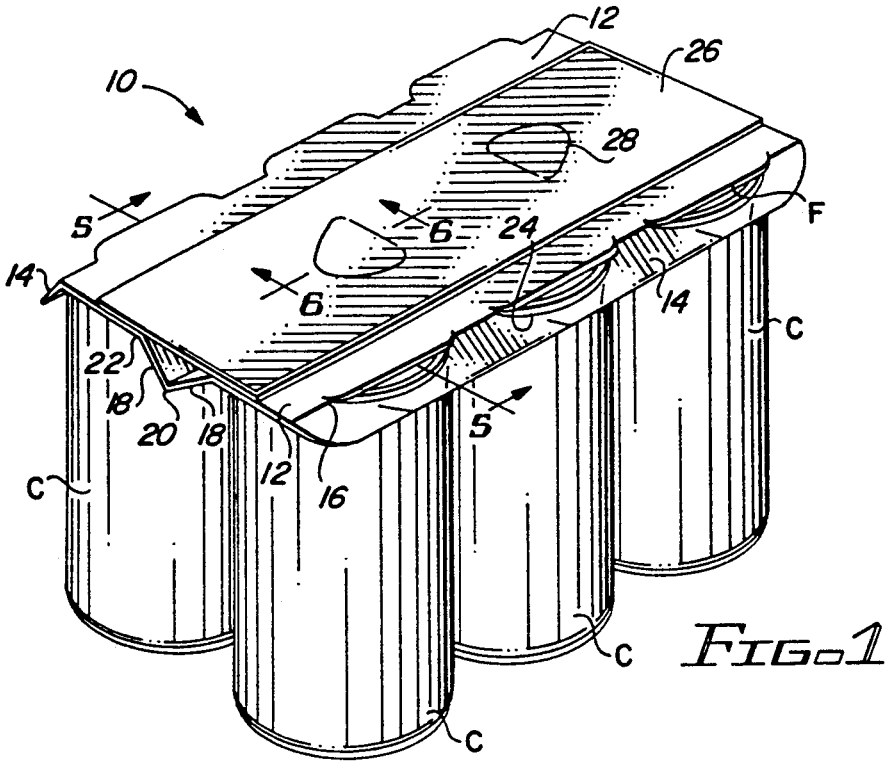
FIG. 1 is a pictorial view of a package of beverage cans the top portions of which are held by the carrier of the invention.

Referring to FIG. 1, a carrier 10 is comprised of a panel 12 having side edge portions 14 which are folded down about fold lines 16. The central portion of the panel includes ribs 18 which are connected to each other by fold line 20 and to the panel 12 by parallel fold lines 22. The chimes F of cans C protrude through slots 24 in the edge portions 14 and through similar slots in the ribs 18, which are not visible in this view. A reinforcing strip 26 adhered to the upper surface of the panel 12 includes finger openings 28 which overlie finger openings in the ribs 18, also not visible in this view.

Although the carrier is illustrated is being adapted to carry six cans, it will be understood that the invention is not limited by the number of articles supported by the carrier. The articles to be carried must be arranged in a plurality of rows, however, in order to create the central ribs 18 in the panel 12.

Figure 2:
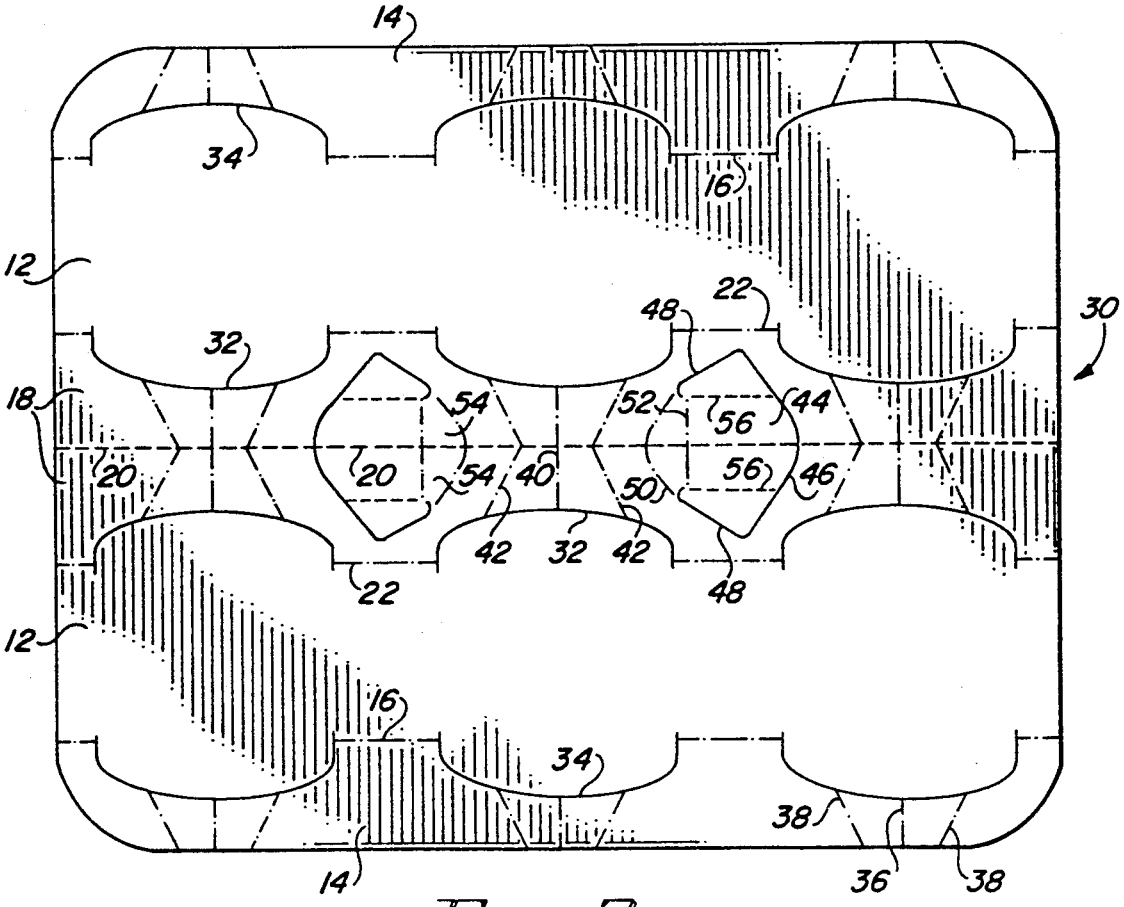
FIG. 2 is a plan view of a blank for forming the main support panel of the carrier of FIG. 1.

Referring to FIG. 2, wherein like reference numerals to those used in FIG. 1 denote like structure, the carrier panel 12 is formed from a generally rectangular blank 30. The fold line 20 is centrally located and extends the full length of the panel. The parallel fold lines 22, which create the rib sections 18, are each interrupted by three curved slits 32, which may be referred to as C-shaped slits, the convex sides of which face the central fold line 20. Each fold line 16 is also interrupted by three C-shaped slits 34 similar to the slits 32 and located so that the concave sides of the slits 34 face the concave sides of opposed slits 32 to form pairs of slits. Preferably, the C-shaped slits terminate slightly beyond their associated fold line 16 or 22 to resist the tendency to tear at this stress point.

Perpendicular score lines 36 and angled score lines 38 extend from the side edges of the panel 12 to the slits 34 to facilitate the conforming of the edge pane portions 14 to the curvature of the cans and to distribute lifting stresses to the ends of the support sections. Similarly, the rib sections 18 contain perpendicular and angled score lines 40 and 42, respectively, for the same purposes. Finger openings in the central rib portions of the blank are covered by tabs 44. The openings and tabs are formed by slits which include curved transverse portions 46 and side portions 48 which converge toward the central fold line 20. The tabs 44 are connected to the rib sections 18 along score line 52 which is perpendicular to the fold line 20 and extends between the small hook-shaped slits at the ends of the slit portions 48. In addition, curved score lines 50, which are symmetrically arranged with respect to the central fold line 20, extend between the ends of the slit portions 48. Segments 54 of the inner support section are thus defined by the curved score line 50, the perpendicular score line 52, and the central fold line 20, the function of which is explained below. The tabs are also provided with fold lines 56 on either side of and parallel to the central fold line 20.

Figure 3:
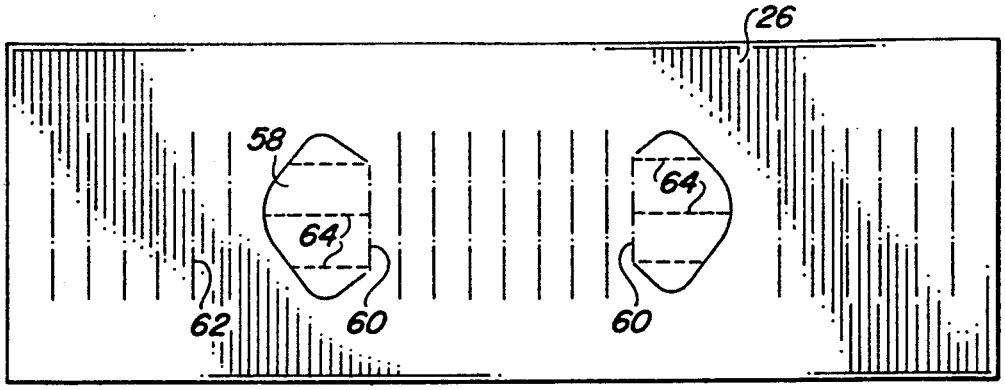
FIG. 3 is a plan view of a reinforcing strip adapted to be adhered to the carrier blank of FIG. 2.

FIG. 3 shows the reinforcing strip 26 as having a length substantially equal to or slightly less than the length of the carrier and a width which allows the strip to extend beyond the edges of the reinforcing ribs 18. The finger holes 28 in the reinforcing strip are covered by tabs 58 which are connected by transverse score lines 60. The score lines 60 are located so as to substantially overlie the score lines 52 in the main carrier panel 12. The tabs 28 are no larger, and preferably are slightly smaller, than the finger hole tabs 44 of the panel 12. A number of transverse score lines 62 are provided on either side of the finger holes 28 to better enable the reinforcing strip to follow the contour of the panel 12, which tends to bulge slightly between the slits 32 and 34 as a consequence of the pressures exerted when the carrier is applied to the cans. The tabs 58 also include longitudinal fold lines 64 similar to the fold lines 56 of the tabs 44.

The fold lines 20, 56 and 64 may be in the form of skip-cut lines to facilitate folding of the blank along these lines during formation of the carrier. It is preferred, however, that the fold lines 16 and 22 of the main panel 12 be in the form of score lines to make the carrier more rigid and resistant to tearing. The fold lines 50 and 52 of the tabs 44 are also preferably in the form of score lines to better enable the tabs to function in the desired manner described below.

To form the carrier 10 of FIG. 1, the blank 30 is positioned on top of a group of six adjacent cans C which have been arranged in two rows of three each so that the C-shaped slits are substantially aligned with opposite portions of the rims of the cans. Since the rib sections 18 are still in planar unfolded condition at this point, the two rows of cans will be spaced apart a short distance in order to be properly aligned with the blank, as is well known in the art. Relative movement between the blank 30 and the cans is caused by applying downward pressure to the blank. Since the distance between the midpoints of opposite C-shaped slits 32 and 34 is substantially equal to the reduced diameter portion Of a can just below the can chime, when relative movement of the cans and blank occurs the can chimes are forced through the slits due to the resiliency of the paperboard until the locking edges formed by the C-shaped slits at the reinforcing rib sections 18 and the edge portions 14 snap back into the reduced diameter portion of the cans. During this maneuver, the locking edges formed by the C-shaped slits move downwardly relative to the panel 12, causing the rib sections to fold up about the fold line 20. This moves the panel portions 12 toward each other and brings the two rows of cans into contact with each other. The carrier blank may be moved relative to the cans and the top panel flaps tightened into their final position by any suitable means. Although details of apparatus for carrying out these functions are not disclosed herein, the design of such equipment is well within the scope of those skilled in the packaging art. For example, the method of assembly disclosed in U.S. Pat. No. 3,653,503 could be employed.

Figure 4:
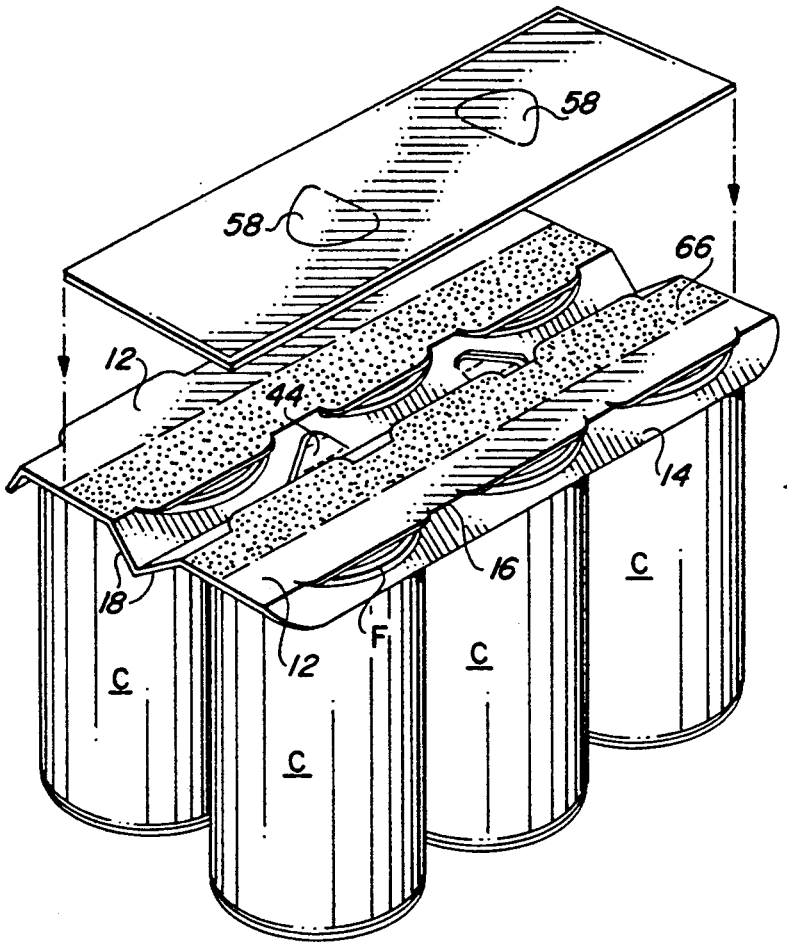
FIG. 4 is a pictorial view of the primary carrier blank after it has been applied to two rows of beverage cans, with the reinforcing strip of the carrier ready to be applied.
Figure 5:
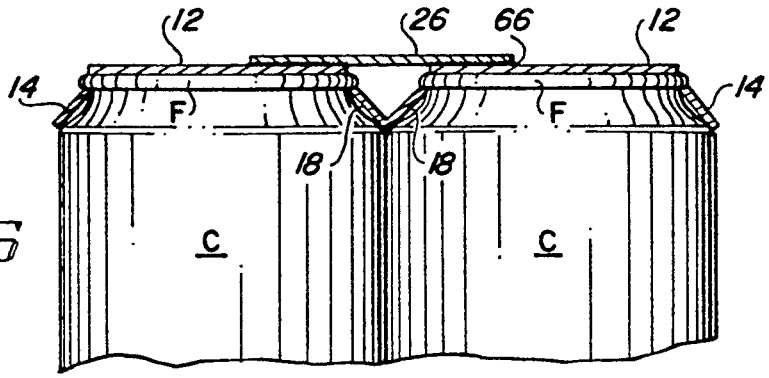
FIG. 5 is an enlarged partial sectional view of the carrier package taken on line 5–5 of FIG. 1.
Figure 6:
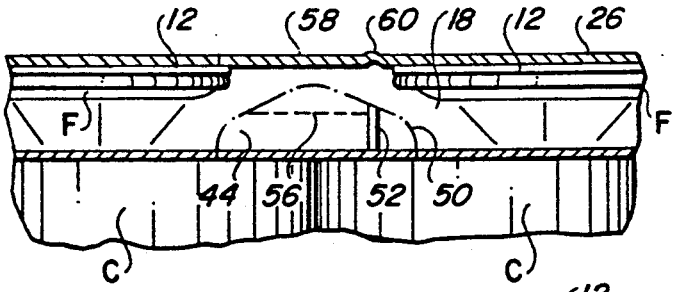
FIG. 6 is an enlarged partial longitudinal sectional view of the carrier package taken on line 6–6 of FIG. 1.

The arrangement of the carrier blank 30 and the packaged cans is illustrated in FIG. 4. To complete the formation of the carrier of FIG. 1, the reinforcing strip 26 is adhered to the top panel 12 in the glue areas 66 so as to span the wedge shaped rib sections 18. This is more clearly illustrated in FIG. 5, which shows the reinforcing strip 26 in place, with the edge portions 14 and the ribs 18 in engagement with the underside of the can chimes F. It will be understood that the reinforcing strip holds the ribs 18 in their folded wedge-shaped configuration to thereby strengthen the carrier. When the carrier is at rest, prior to a user activating the finger hole tabs, the finger hole tabs 44 are folded up about their central fold lines 20, as best shown in FIG. 6, with the finger hole tabs 58 of the reinforcing strip 26 remaining in unfolded condition overlying the finger hole tabs 44.

Figure 7:
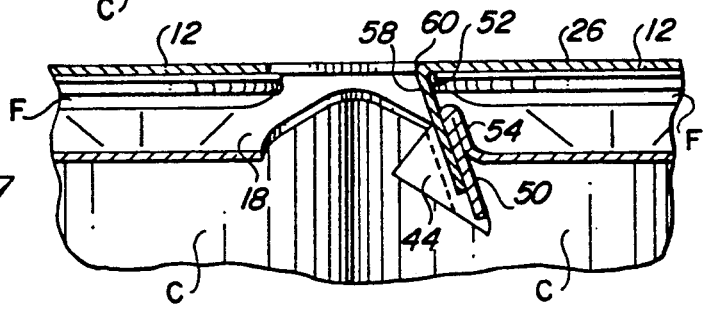
FIG. 7 is an enlarged partial longitudinal sectional view similar to the view of FIG. 6, but showing the finger hole tabs after being pushed down into the package as they would be during lifting.
Figure 8:
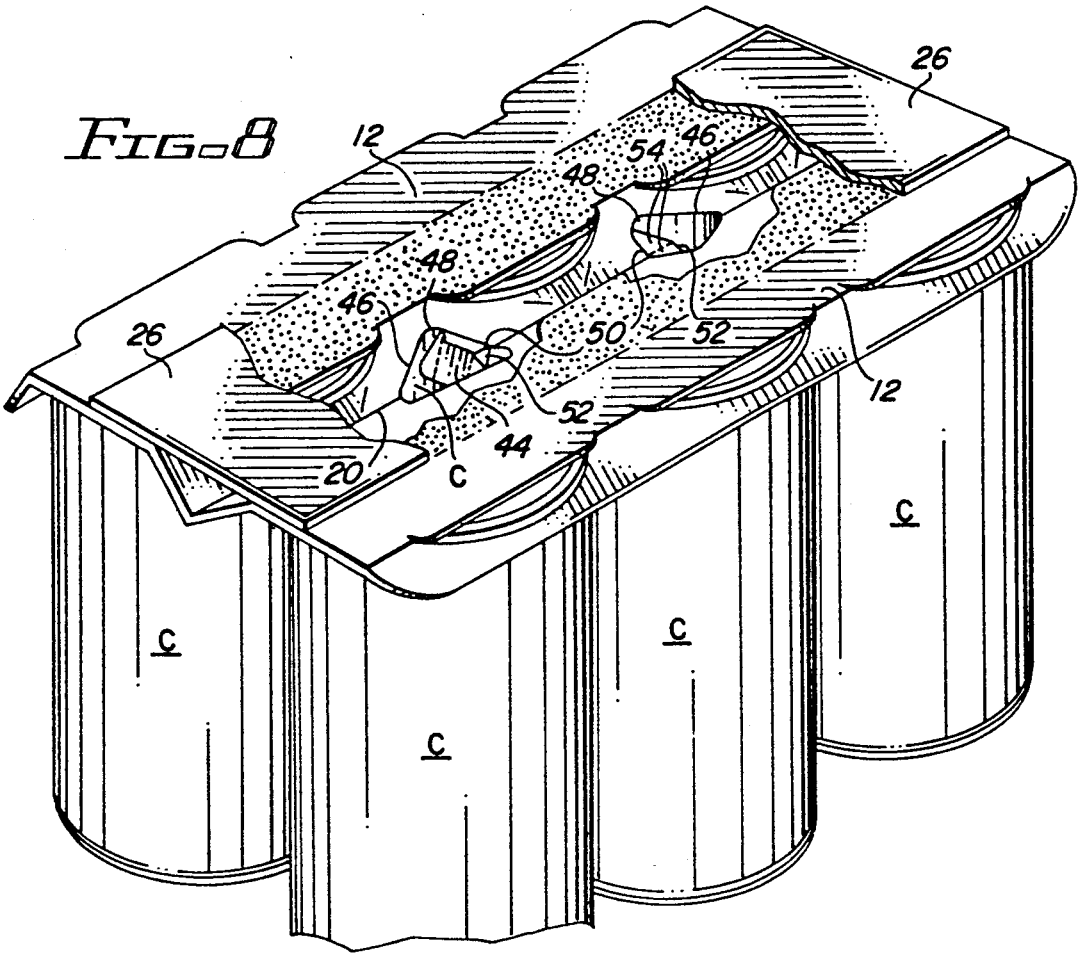
FIG. 8 is a partial pictorial view of the area of the package illustrated in FIG. 7, with portions of the reinforcing strip removed for the sake of clarity.

When a user inserts thumb and finger through the finger holes in the reinforcing strip 26, the tabs 58 are folded down about their score lines 60, allowing the thumb and finger to engage the finger hole tabs 44 of the ribs 18 and fold them down about their score lines 52. The tabs 44 are pivoted into the interior of the package by the thumb and finger until the wing portions on either side of the central fold line 20 contact the adjacent cans C. The tabs 44 do not fold down about the arcuate score lines 50 since their curved shape does not permit a normal folding or pivoting action to take place. When the tabs 44 are folded back about their fold lines 52, however, the squeezing movement of the thumb and finger toward each other as a user grips the finger holes prior to lifting the carrier causes the segments 54 of the inner support section to pivot up for a limited distance about the score line 50 while at the same time folding down about the central fold line 20. This position is illustrated in FIG. 7, which omits the user's finger or thumb for the sake of clarity. It is also illustrated in FIG. 8, which omits portions of the reinforcing strip in order to better view the folding action of the tabs 44.

Since the folding action of the segments 54 is limited due to the connecting curved score line 50, the segments provide a very solid support which buttresses the finger hole tabs 44 and provides firm resistance to the pressures exerted by the thumb and finger during lifting. The dimensions of the tabs and inner support segments may vary, but should be such that the score lines 52 are designed to fold up during lifting to a point no higher than the underside of the reinforcing strip 26. The hooked slits at the ends of the score lines 52 prevent tearing of the paperboard between the finger hole and the chime slits 32 as well as along the score lines 52.

It will now be clear that the invention improves the strength of clip-type paperboard carriers without increasing their cost. Obviously, although the invention has been described in connection with a carrier designed to hold six beverage cans, the principles of the invention may be incorporated in carriers designed to hold fewer or more cans. Moreover, the invention is not limited to use with cans, but may be extended to other types of articles having a rim or other projection capable of being gripped by locking or supporting edges of the carrier. Because the invention is not necessarily limited to all the specific details described in connection with the preferred embodiment, except as they may be within the scope of the appended claims, changes to certain features of the preferred embodiment which do not alter the overall basic function and concept of the invention are contemplated.

WHAT IS CLAIMED IS:

1. A carrier containing adjacent rows of articles, each article having an upper portion which includes an outwardly projecting lip, comprising:

a support panel including two spaced parallel inner fold lines extending longitudinally of the panel and two outer fold lines parallel to and outwardly spaced from the inner fold lines;

the support panel including downwardly extending outer support sections connected thereto along the outer fold lines and downwardly extending inner support sections connected thereto along the inner fold lines, the inner support sections converging toward each other and being connected to each other along a central fold line;

each inner and outer fold line being interrupted by spaced slits forming slots in the support sections through which at least portions of the projecting lips of the articles protrude;

the slots having lower surfaces engaging the underside of the protruding portions of the article lips to thereby support the articles;

a reinforcing strip attached to the support panel and spanning the inner fold lines;

spaced finger holes in the inner support sections and in the reinforcing strip, the finger holes in the reinforcing strip overlying the finger holes in the inner support sections;

each inner support section finger hole having an inner transverse edge and being at least partially covered by tabs connected to the inner support sections by fold lines extending along said inner transverse edges; and the inner support sections including second transverse fold lines located adjacent the first transverse fold lines, the ends of each second transverse fold line extending substantially from the ends of the first transverse fold lines.

2. A carrier according to claim 1, wherein each second transverse fold line includes portions which converge toward a point on the central fold line of the support panel.

3. A carrier according to claim 2, wherein the converging portions are arcuate in shape.

4. A carrier according to claim 1, wherein the finger holes in the inner support sections are symmetrically arranged with respect to the central fold line.

5. A carrier according to claim 4, wherein the inner support section finger hole tabs include a longitudinally extending fold line aligned with the central fold line of the inner support sections.

6. A carrier according to claim 4, wherein the inner support section finger hole tabs include additional longitudinal fold lines on either side of the first mentioned finger hole tab fold line.

7. A carrier according to claim 6, wherein the additional longitudinal fold lines extend from the ends of the first transverse fold lines.

8. A carrier according to claim 1, wherein the support section finger holes are formed by slits ending in hook-shaped portions located adjacent the ends of the first transverse fold lines.

9. A carrier according to claim 1, wherein the finger holes in the reinforcing strip are at least partially covered by tabs connected to the strip along a transverse fold line substantially overlying the first transverse fold lines of the inner support sections.

10. A carrier according to claim 1, wherein the articles in the package are cans and the outwardly extending flanges of the articles are can chimes, the support panel directly overlying the top surfaces of the cans.

11. A carrier according to claim 1, wherein the reinforcing strip includes a plurality of transverse score lines between the finger holes in the strip and outwardly thereof.

12. A two-piece blank for forming the support panel of a clip-type carrier adapted to support adjacent rows of articles from outwardly projecting lips on the upper portions of the articles, comprising:

a generally rectangular sheet including two spaced parallel inner fold lines extending longitudinally of the sheet and two outer fold lines parallel to and outwardly spaced from the inner fold lines;

the sheet including outer support sections connected thereto along the outer fold lines and inner support sections connected thereto along the inner fold lines, the inner support sections connected to each other along a central fold line;

each inner and outer fold line being interrupted by spaced slits forming slots in the support sections for receiving at least portions of the projecting lips of the articles to be carried;

the edges of the outer support sections formed by folding the outer support sections down about their connecting fold lines being adapted to engage the underside of the outwardly projecting lips of articles;

a generally rectangular reinforcing strip adapted to be attached to the support panel and having a width capable of spanning the inner fold lines of the sheet;

spaced finger holes in the inner support sections and in the reinforcing strip, the finger holes in the reinforcing strip adapted to overlie the finger holes in the inner support sections of a carrier formed from the blanks;

each inner support section finger hole having an inner transverse edge and being at least partially covered by tabs connected to the inner support sections by fold lines extending along said inner transverse edges; and the inner support sections including second transverse fold lines located adjacent the first transverse fold lines, the ends of each second transverse fold line extending from the ends of the first transverse fold lines.

13. A two-piece blank according to claim 12, wherein the second transverse fold lines include portions which converge toward a point on the central fold line, the finger holes in the inner support sections being symmetrically arranged with respect to the central fold line.

14. A two-piece blank according to claim 13, wherein the inner support section finger hole tabs include a longitudinally extending fold line aligned with the central fold line of the inner support sections.

15. A two-piece blank according to claim 12, wherein the finger holes in the reinforcing strip are at least partially covered by tabs connected to the strip along a transverse fold line located so as to substantially overlie the first transverse fold lines of the inner support sections.

* * * * *